US006889024B2

(12) United States Patent
Shiraki et al.

(10) Patent No.: US 6,889,024 B2
(45) Date of Patent: May 3, 2005

(54) IMAGE-FORMING APPARATUS AND COMPUTER SYSTEM

(75) Inventors: Takayuki Shiraki, Nagano-ken (JP); Yoichi Yamada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 13 days.

(21) Appl. No.: 10/463,861

(22) Filed: Jun. 18, 2003

(65) Prior Publication Data

US 2004/0018030 A1 Jan. 29, 2004

(30) Foreign Application Priority Data

Jun. 24, 2002 (JP) ..... 2002-182705

(51) Int. Cl.[7] ..... G03G 15/01; G03G 15/08
(52) U.S. Cl. ..... 399/227; 399/43; 399/44
(58) Field of Search ..... 399/27, 29, 43, 399/44, 53, 94, 97, 223, 226, 227

(56) References Cited

U.S. PATENT DOCUMENTS 5,799,228 A * 8/1998 Iwata et al. ..... 399/94
5,915,151 A 6/1999 Kaneko et al.
6,104,900 A 8/2000 Ishikawa et al.
6,122,461 A * 9/2000 Shinohara ..... 399/43
6,295,429 B1 * 9/2001 Isobe et al. ..... 399/227
6,324,352 B1 * 11/2001 Suzuki ..... 399/227 X
6,327,449 B1 * 12/2001 Matsuzaki ..... 399/227
2003/0133719 A1 * 7/2003 Tsuruya et al. ..... 399/227 X

FOREIGN PATENT DOCUMENTS

EP 0 678 794 A2 10/1995

* cited by examiner

*Primary Examiner*—Sophia S. Chen
(74) *Attorney, Agent, or Firm*—Sughrue Mion, PLLC

(57) ABSTRACT

An image-forming apparatus includes a photoconductor on which a latent image can be formed, and a moving member having attaching/detaching sections to/from each of which one of developing units can be attached/detached. Each of the developing units has a developer container for containing developer that is capable of developing the latent image formed on the photoconductor. The developer in the developer container is stirred by moving the moving member when none of the developing units attached to each of the attaching/detaching sections is developing a latent image formed on the photoconductor, and a timing for moving the moving member to stir the developer in the developer container is variable.

10 Claims, 12 Drawing Sheets

| | temperature inside apparatus (°C) | | |
|---|---|---|---|
| | 10～23 | 23～30 | 31～35 |
| total number of sheets printed | 100 | 90 | 80 |
| total number of times the developer roller has rotated | 400 | 360 | 320 |
| total number of times Vsync signals have been generated | 50 | 45 | 40 |

FIG. 5

RAM131

| address | contents of information (8 bits) |
|---|---|
| 00H | temperature inside apparatus |
| 01H | total number of sheets printed |
| 02H | total number of times of rotations of Y developing roller |
| 03H | total number of times of rotations of M developing roller |
| 04H | total number of times of rotations of C developing roller |
| 05H | total number of times of rotations of K developing roller |
| 06H | total number of times Vsync signals have been generated |
| ⋮ | ⋮ |

FIG. 8

IMAGE-FORMING APPARATUS AND COMPUTER SYSTEM

CROSS-REFERENCE TO RELATED APPLICATIONS

The present application claims priority upon Japanese Patent Application No. 2002-182705 filed Jun. 24, 2002, which is herein incorporated by reference.

BACKGROUND OF THE INVENTION

1. Field of the Invention

The present invention relates to an image-forming apparatus and a computer system. More specifically, the present invention relates to an image-forming apparatus including a photoconductor on which a latent image can be formed, and a moving member having attaching/detaching sections to/from each of which one of at least two developing units, each having a developer container for containing developer that is capable of developing the latent image formed on the photoconductor, can be attached/detached, and also to a computer system configured by connecting an image-forming apparatus and a computer unit.

2. Description of the Related Art

Some image-forming apparatuses, such as laser beam printers, have a moving member, such as a rotary, to which several developing units can be detachably attached. The image-forming apparatus performs full-color printing by rotationally moving the moving member, having the developing units attached thereto, so as to make a certain developing unit selectively oppose a photoconductor and develop a latent image formed on the photoconductor.

Developer, especially powder developer, that is contained in the developing unit attached to the image-forming apparatus may cause physical agglomeration depending on changes in the environment in which the image-forming apparatus is operated. If the developer in the developing unit is left in a physically-agglomerated state, the developer will settle at the bottom of the developer container and the flowability of the developer will decrease. This can affect image forming.

SUMMARY OF THE INVENTION

The present invention has been contrived in view of the above and other issues, and an object thereof is to provide an image-forming apparatus and a computer system capable of reducing a decrease in flowability of developer.

One aspect of the present invention is an image-forming apparatus comprising: a photoconductor on which a latent image can be formed; and a moving member having at least two attaching/detaching sections to/from each of which one of at least two developing units can be attached/detached, each of the developing units having a developer container for containing developer that is capable of developing the latent image formed on the photoconductor, wherein the developer in the developer container is stirred by moving the moving member when none of the at least two developing units attached to each of the at least two attaching/detaching sections is developing a latent image formed on the photoconductor, and a timing for moving the moving member to stir the developer in the developer container is variable.

Features of the present invention other than the above will become clear by the description of the present specification with reference to the accompanying drawings.

BRIEF DESCRIPTION OF THE DRAWINGS

For more complete understanding of the present invention and the advantages thereof, reference is now made to the following description taken in conjunction with the accompanying drawings wherein:

FIG. 5 is a diagram for illustrating table data stored in a ROM 130;

FIG. 8 is a diagram for illustrating information stored in a RAM 131;

DETAILED DESCRIPTION OF THE INVENTION

Figure 1:
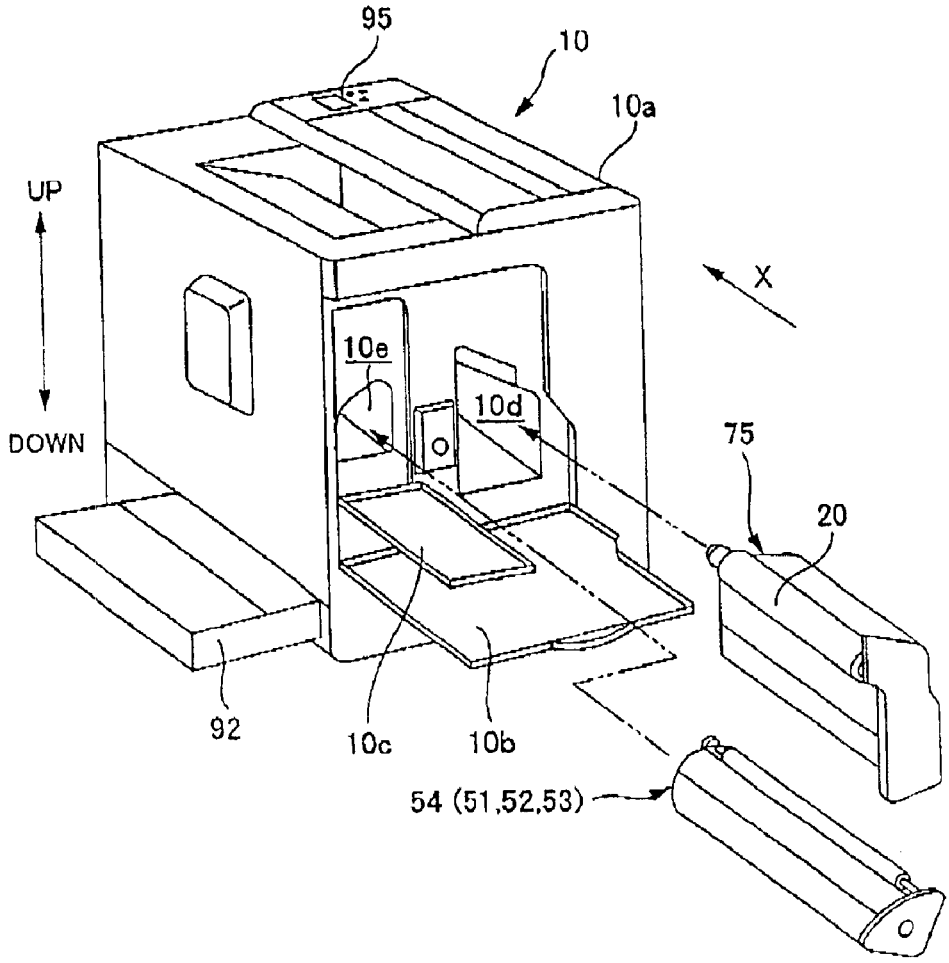
FIG. 1 is a diagram illustrating a configuration for attaching/detaching developing unit(s) 54 (51, 52, 53) and a photoconductor unit 75 to/from a printer body 10*a;*

At least the following matters will be made clear by the description in the present specification and the illustration in the accompanying drawings.

An image-forming apparatus comprises: a photoconductor on which a latent image can be formed; and a moving member having at least two attaching/detaching sections to/from each of which one of at least two developing units can be attached/detached, each of the developing units having a developer container for containing developer that is capable of developing the latent image formed on the photoconductor. The developer in the developer container is stirred by moving the moving member when none of the at least two developing units attached to each of the at least two attaching/detaching sections is developing a latent image formed on the photoconductor, and a timing for moving the moving member to stir the developer in the developer container is variable.

According to such an image-forming apparatus, since the timing for moving the moving member to stir the developer in the developer container is variable, it becomes possible to reduce a decrease in flowability of the developer. For example, in an image-forming apparatus using powder developer, it is possible to prevent the developer from escaping out from the developing unit when the developing unit is developing a latent image on the photoconductor by appropriately moving the moving member as described above.

Further, in the image-forming apparatus described above, the moving member may be capable of moving rotationally.

According to such an image-forming apparatus, it is possible to reduce a decrease in flowability of the developer by making the timing for moving the moving member, which moves rotationally, variable.

Further, in the image-forming apparatus described above, the moving member may move rotationally to make the at least two developing units selectively oppose the photoconductor when the at least two developing units attached to each of the at least two attaching/detaching sections are to develop a latent image formed on the photoconductor.

According to such an image-forming apparatus, it is possible to reduce a decrease in flowability of the developer by making the timing for moving the moving member, which moves rotationally to make the developing units selectively oppose the photoconductor, variable.

Further, in the image-forming apparatus described above, the timing for moving the moving member may be made variable according to information obtained when only a predetermined one the developing unit, among the at least two developing units attached to each of the at least two attaching/detaching sections, has continuously developed a latent image formed on the photoconductor.

According to such an image-forming apparatus, it is possible to reduce a decrease in flowability of the developer by making the timing for moving the moving member variable according to information obtained when only a predetermined developing unit, among the developing units, has continuously developed a latent image formed on the photoconductor.

Further, in the image-forming apparatus described above, the timing for moving the moving member may be made variable according to information about an environment in which the image-forming apparatus operates.

According to such an image-forming apparatus, it is possible to reduce a decrease in flowability of the developer by making the timing for moving the moving member variable according to information about an environment in which the image-forming apparatus operates.

Further, in the image-forming apparatus described above, the apparatus may further comprise a temperature sensor, and the information about the environment may be temperature information obtained by the temperature sensor.

According to such an image-forming apparatus, it is possible to reduce a decrease in flowability of the developer using the temperature information about the environment in which the image-forming apparatus operates.

Further, in the image-forming apparatus described above, the apparatus may further comprise a humidity sensor, and the information about the environment may be humidity information obtained by the humidity sensor.

According to such an image-forming apparatus, it is possible to reduce a decrease in flowability of the developer using the humidity information about the environment in which the image-forming apparatus operates.

Further, in the image-forming apparatus described above, the timing for moving the moving member may be made variable according to the information about the environment, and information about a number of sheets printed that is associated with the information about the environment.

According to such an image-forming apparatus, it is possible to effectively reduce a decrease in flowability of the developer by making the timing for moving the moving member variable according to a result obtained by combining the information about the environment and the information about a number of sheets printed.

Further, in the image-forming apparatus described above, the moving member may be moved to stir the developer in the developer container when the information about the environment continues to stay at a predetermined value for a predetermined period of time, and the information about a number of sheets printed reaches a value that is associated with the predetermined value of the information about the environment.

According to such an image-forming apparatus, it is possible to reduce a decrease in flowability of the developer by making the moving member move when the the information about the environment continues to stay at a predetermined value for a predetermined period of time, and the information about a number of sheets printed reaches a value that is associated with the predetermined value of the information about the environment.

Further, in the image-forming apparatus described above, each of the developing units may have a developer bearing member for bearing the developer, and the timing for moving the moving member may be made variable according to the information about the environment, and information about a number of times the developer bearing member has rotated that is associated with the information about the environment.

According to such an image-forming apparatus, it is possible to effectively reduce a decrease in flowability of the developer by making the timing for moving the moving member variable according to a result obtained by combining the information about the environment and the information about a number of times the developer bearing member has rotated.

Further, in the image-forming apparatus described above, the moving member may be moved to stir the developer in the developer container when the information about the environment continues to stay at a predetermined value for a predetermined period of time, and the information about a number of times the developer bearing member has rotated reaches a value that is associated with the predetermined value of the information about the environment.

According to such an image-forming apparatus, it is possible to reduce a decrease in flowability of the developer by making the moving member move when the the information about the environment continues to stay at a predetermined value for a predetermined period of time, and the information about a number of times the developer bearing member has rotated reaches a value that is associated with the predetermined value of the information about the environment.

Further, in the image-forming apparatus described above, the apparatus may further comprise a transferring medium serving as a medium in transferring an image on the photoconductor to an object subjected to transferring, and the timing for moving the moving member may be made variable according to the information about the environment, and information about a number of times the transferring medium has moved that is associated with the information about the environment.

According to such an image-forming apparatus, it is possible to effectively reduce a decrease in flowability of the developer by making the timing for moving the moving member variable according to a result obtained by combining the information about the environment and the information about a number of times the transferring medium has moved.

Further, in the image-forming apparatus described above, the moving member may be moved to stir the developer in the developer container when the information about the environment continues to stay at a predetermined value for a predetermined period of time, and the information about a number of times the transferring medium has moved reaches a value that is associated with the predetermined value of the information about the environment.

According to such an image-forming apparatus, it is possible to reduce a decrease in flowability of the developer by making the moving member move when the the information about the environment continues to stay at a predetermined value for a predetermined period of time, and the information about a number of times the transferring medium has moved reaches a value that is associated with the predetermined value of the information about the environment.

Further, it is possible to provide an image-forming apparatus comprising: a photoconductor on which a latent image can be formed; and a moving member having at least two attaching/detaching sections to/from each of which one of at least two developing units can be attached/detached, each of the developing units having a developer container for containing developer that is capable of developing the latent image formed on the photoconductor, wherein the developer in the developer container is stirred by moving the moving member when none of the at least two developing units attached to each of the at least two attaching/detaching sections is developing a latent image formed on the photoconductor, a timing for moving the moving member to stir the developer in the developer container is variable, the moving member is capable of moving rotationally, the moving member moves rotationally to make the at least two developing units selectively oppose the photoconductor when the at least two developing units attached to each of the at least two attaching/detaching sections are to develop a latent image formed on the photoconductor, the timing for moving the moving member is made variable according to information about an environment in which the image-forming apparatus operates, the image-forming apparatus further comprises a temperature sensor, and the information about the environment is temperature information obtained by the temperature sensor, the timing for moving the moving member is made variable according to the information about the environment, and information about a number of sheets printed that is associated with the information about the environment, and the moving member is moved to stir the developer in the developer container when the information about the environment continues to stay at a predetermined value for a predetermined period of time, and the information about a number of sheets printed reaches a value that is associated with the predetermined value of the information about the environment.

Further, it is possible to provide a computer system comprising: an image-forming apparatus having: a photoconductor on which a latent image can be formed; and a moving member having at least two attaching/detaching sections to/from each of which one of at least two developing units can be attached/detached, each of the developing units having a developer container for containing developer that is capable of developing the latent image formed on the photoconductor, wherein the developer in the developer container is stirred by moving the moving member when none of the at least two developing units attached to each of the at least two attaching/detaching sections is developing a latent image formed on the photoconductor; and a computer unit that is capable of being connected to the image-forming apparatus, wherein a timing for moving the moving member to stir the developer in the developer container is variable.

Outline of Image-Forming Apparatus (Laser Beam Printer)

Figure 2:
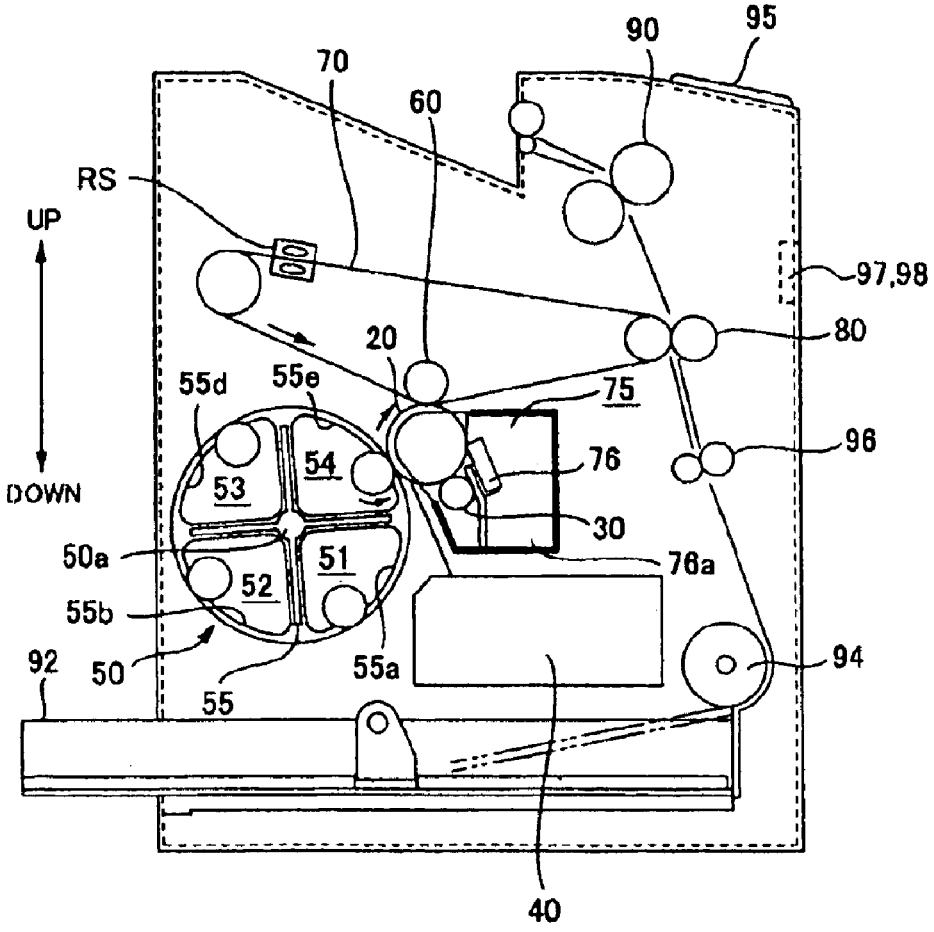
FIG. 2 is a section view showing some main structural components that configure the printer 10.

Next, with reference to FIG. 1 and FIG. 2, the outline of a laser beam printer will be described, taking a laser beam printer 10 (also referred to as a "printer 10"), which serves as an image-forming apparatus, as an example. FIG. 1 is a diagram illustrating a configuration for attaching/detaching developing unit(s) 54 (51, 52, 53) and a photoconductor unit 75 to/from the printer body 10*a*. FIG. 2 is a diagram showing some main structural components that configure the printer 10. Note that FIG. 2 is a section view taken along a plane perpendicular to direction X shown in FIG. 1. In FIG. 1 and FIG. 2, the vertical direction is shown by the arrow; for example, a paper-supply tray 92 is arranged at a lower section of the printer 10, and a fusing unit 90 is arranged at an upper section of the printer 10.

<Attaching/Detaching Configuration>

The developing unit(s) 54 (51, 52, 53) and the photoconductor unit 75 are attachable to and detachable from the printer body 10*a*. The printer 10 is constructed by attaching the developing unit(s) 54 (51, 52, 53) and the photoconductor unit 75 to the printer body 10*a*.

The printer body 10*a* has: a first open/close lid 10*b* that can be opened and closed; a second open/close lid 10*c* that can be opened and closed and is arranged further to the inside than the first open/close lid 10*b*; a photoconductor unit attach/detach opening 10*d* for attachment/detachment of the photoconductor unit 75; and a developing unit attach/detach opening 10*e* for attachment/detachment of the developing unit(s) 54 (51, 52, 53).

When the user opens the first open/close lid 10*b*, it becomes possible to attach/detach the photoconductor unit 75 to/from the printer body 10*a* through the photoconductor unit attach/detach opening 10*d*. When the user opens the second open/close lid 10*c*, it becomes possible to attach/detach the developing unit(s) 54 (51, 52, 53) to/from the printer body 10*a* through the developing unit attach/detach opening 10*e*.

<Outline of the Printer 10>

The outline of the printer 10 in a state in which the developing unit(s) 54 (51, 52, 53) and the photoconductor unit 75 are attached to the printer body 10*a* will be described below.

Figure 3:
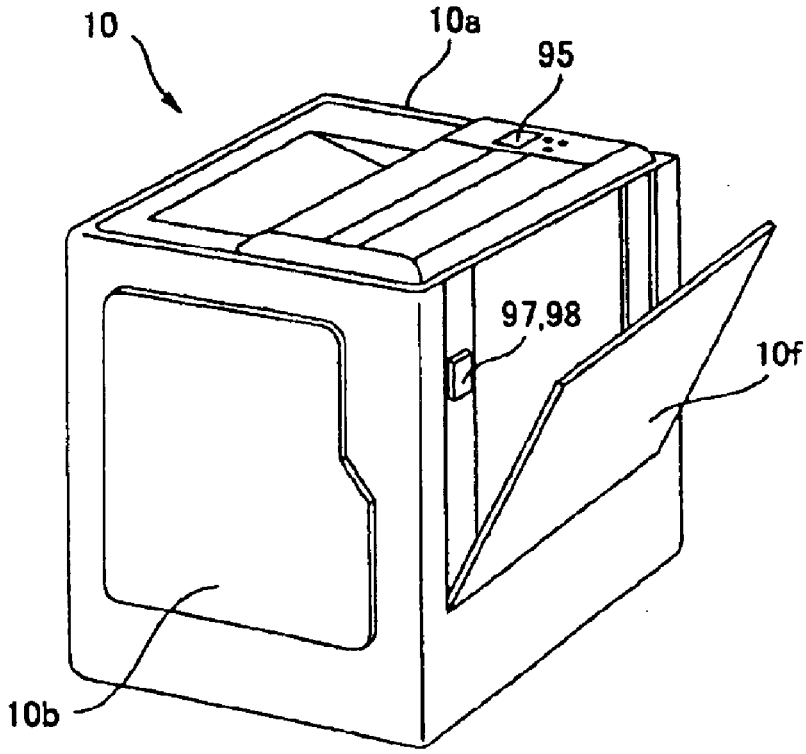
FIG. 3 is a perspective view of the printer 10 taken from a different direction than FIG. 1.

As shown in FIG. 2, the printer 10 according to the present embodiment includes the components described below along the circumferential (rotating) direction of a photoconductor 20, which is a latent image bearing member that bears a latent image: a charging unit 30; an exposing unit 40; a YMCK developing device 50; a first transferring unit 60; an intermediate transferring member 70 which is a transferring medium; and a cleaning blade 76. The printer 10 further includes: a second transferring unit 80; a fusing unit 90; a displaying unit 95 having, for example, a liquid-crystal panel to serve as notifying means to a user; a temperature sensor 97 for detecting the operating temperature of the printer 10; and a control unit (FIG. 4) for controlling the above-mentioned components to control the operations of the printer 10. The temperature sensor 97 is provided in a position at which the inside temperature of the printer 10 during operation thereof can be detected. For example, the temperature sensor 97 is attached on a surface opposing the inner surface of a third open/close lid 10f provided for maintenance purposes, as shown in FIG. 3. Note that a humidity sensor 98 can be used with the temperature sensor 97 to precisely detect the operating environment of the printer 10. Instead, it is possible to use only the humidity sensor 98 to detect the operating environment of the printer 10.

The photoconductor 20 has a cylindrical, conductive base and a photoconductive layer formed on the outer peripheral surface of the base, and can rotate about a central axis. In the present embodiment, the photoconductor 20 rotates clockwise, as shown by the arrow in FIG. 2.

The charging unit 30 is a device for charging the photoconductor 20. The exposing unit 40 is a device for forming a latent image on the charged photoconductor 20 by radiation of laser. The exposing unit 40 includes, for example, a semiconductor laser, a polygon mirror, and an F-θ lens, and radiates modulated laser onto the charged photoconductor 20 according to the image signal having been input from the host computer (not shown) such as a personal computer and a word processor.

The YMCK developing device 50 has: a rotary 55, which serves as a moving member; and four developing units attached to the rotary 55. The rotary 55 is capable of being rotated and has four attaching/detaching sections 55*a*, 55*b*, 55*d*, 55*e* to/from which the four developing units 51, 52, 53, 54 can respectively be attached/detached through the developing unit attach/detach opening 10*d*. The cyan developing unit 51 containing cyan (C) toner can be attached to and detached from the attaching/detaching section 55*a*. The magenta developing unit 52 containing magenta (M) toner can be attached to and detached from the attaching/detaching section 55*b*. The black developing unit 53 containing black (K) toner can be attached to and detached from the attaching/detaching section 55*d*. The yellow developing unit 54 containing yellow (Y) toner can be attached to and detached from the attaching/detaching section 55*e*.

The rotary 55 rotates to move the four developing units 51, 52, 53, 54, which have been attached to their respective attaching/detaching sections 55*a*, 55*b*, 55*d*, 55*e*. In other words, the rotary 55 makes the attached developing units 51, 52, 53, 54 rotate about a central shaft 50*a*, while maintaining their relative positions. The printer body 10*a* has a developing roller drive motor (not shown). When one of the four developing units 51, 52, 53, 54 selectively opposes the photoconductor 20, the developing roller drive motor drives a developing roller of the developing unit opposing the photoconductor 20 so that the roller rotates. The developing roller drive motor is directly or indirectly connected to a driving force transferring section of the developing roller of the developing unit opposing the photoconductor 20 to transfer driving force to the roller. The developing units 51, 52, 53, 54 are made to selectively oppose the latent image formed on the photoconductor 20, and the toner contained in each of the developing units 51, 52, 53, 54 develops the latent image on the photoconductor 20. Note that details of the developing units will be described later.

The first transferring unit 60 is a device for transferring a single-color toner image formed on the photoconductor 20 onto the intermediate transferring member 70. When the toners of all four colors are sequentially transferred in a superimposing manner, a full-color toner image will be formed on the intermediate transferring member 70.

The intermediate transferring member 70 is an endless (annular) belt, and is driven to rotate at substantially the same circumferential speed as the photoconductor 20. In the vicinity of the intermediate transferring member 70 is provided a synchronization reading sensor RS. The synchronization reading sensor RS is a sensor for detecting a reference position of the intermediate transferring member 70. The sensor RS is capable of obtaining synchronizing signals Vsync in the sub-scanning direction (the direction in which the paper is fed) perpendicular to a main-scanning direction. The synchronization reading sensor RS includes a light emitting section for light emission, and a light receiving section for receiving light. The synchronization reading sensor RS gives off a pulse signal when light emitted from the light emitting section passes through a hole formed in a predetermined position of the intermediate transferring member 70 and the light receiving section receives the light. The pulse signal is given off every time the intermediate transferring member 70 makes one turn.

The second transferring unit 80 is a device for transferring the single-color toner image or the full-color toner image formed on the intermediate transferring member 70 onto an object subjected to transferring such as paper, film, and cloth.

The fusing unit 90 is a device for fusing, to the object subjected to transferring, the single-color toner image or the full-color toner image which has been transferred thereto, to make the toner image into a permanent image.

The cleaning blade 76 is made of rubber and is placed in contact with (or, abuts against) the surface of the photoconductor 20. The cleaning blade 76 scrapes off and removes the toner remaining on the photoconductor 20 after the toner image has been transferred onto the intermediate transferring member 70 by the first transferring unit 60.

The photoconductor unit 75 is arranged between the first transferring unit 60 and the exposing unit 40 and includes the photoconductor 20, the charging unit 30, the cleaning blade 76, and a used-toner container 76*a* for containing toner scraped off by the cleaning blade 76.

Figure 4:
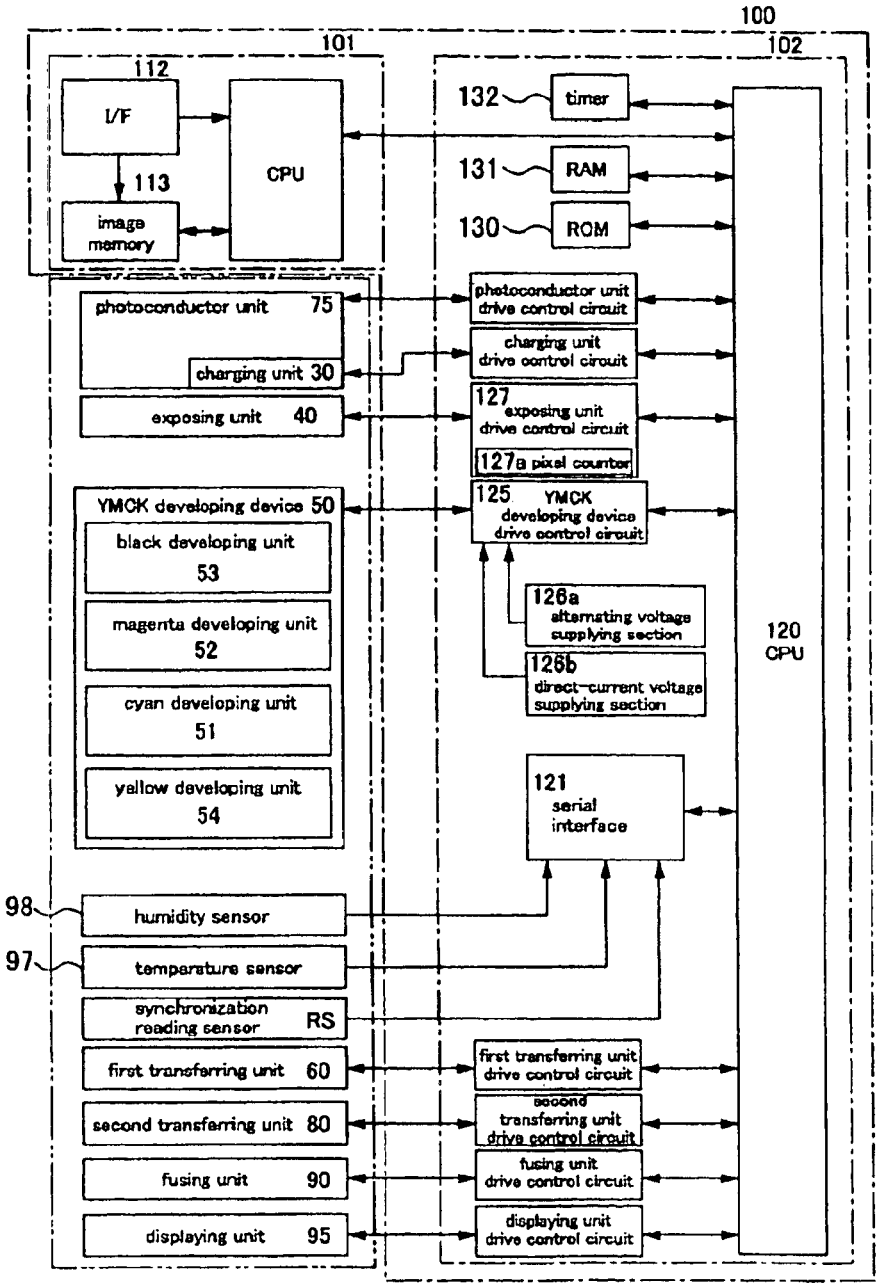
FIG. 4 is a block diagram showing a control unit 100 provided in the printer 10.

The control unit 100 comprises a main controller 101 and a unit controller 102 as shown in FIG. 4. An image signal is input to the main controller 101; according to instructions based on the image signal, the unit controller 102 controls each of the above-mentioned units and the like, to form an image.

Operation of the Printer 10

Next, operations of the printer 10 structured as above will be described with reference to other structural components.

First, when an image signal is input from the host computer (not shown) to the main controller 101 of the printer 10 through an interface (I/F) 112, the photoconductor 20 and the intermediate transferring member 70 rotate under the control of the unit controller 102 according to the instructions from the main controller 101. Then, the synchronization reading sensor RS detects the reference position of the intermediate transferring member 70 and outputs a pulse signal. The pulse signal is sent to the unit controller 102 via a serial interface 121. Based on the pulse signal received, the unit controller 121 controls the following operations.

While rotating, the photoconductor 20 is sequentially charged by the charging unit 30 at a charging position. With the rotation of the photoconductor 20, the charged area of the photoconductor 20 reaches an exposure position. The exposing unit 40 forms a latent image in the charged area in accordance with information about an image for the first color, such as yellow Y.

With the rotation of the photoconductor 20, the latent image formed on the photoconductor 20 reaches the developing position, and is developed with yellow toner by the yellow developing unit 54. Thus, a yellow toner image is formed on the photoconductor 20.

With the rotation of the photoconductor 20, the yellow toner image formed on the photoconductor 20 reaches a first transferring position, and is transferred onto the intermediate transferring member 70 by the first transferring unit 60. Here, a first transferring voltage, having an opposite polarity from the charge polarity of the toner, is applied to the first transferring unit 60. Note that during the above, the second transferring unit 80 is kept separated from the intermediate transferring member 70.

By repeating the above-mentioned process for the second, the third, and the fourth colors, toner images in four colors corresponding to the respective image signals are transferred to the intermediate transferring member 70 in a superimposed manner. As a result, a full-color toner image is formed on the intermediate transferring member 70.

With the rotation of the intermediate transferring member 70, the full-color toner image formed on the intermediate transferring member 70 reaches a second transferring position, and is transferred onto an object subjected to transferring by the second transferring unit 80. The object subjected to transferring is carried from the paper-supply tray 92 to the second transferring unit 80 through the paper-feed roller 94 and resisting rollers 96. While the image is being transferred, the second transferring unit 80 is pressed against the intermediate transferring member 70 and a second transferring voltage is applied to the second unit 80.

The full-color toner image transferred onto the object subjected to transferring is heated and pressurized by the fusing unit 90 and fused to the object subjected to transferring.

On the other hand, after the photoconductor 20 passes the first transferring position, the toner attached to the surface of the photoconductor 20 is scraped off by the cleaning blade 76, and the photoconductor 20 is prepared for charging in order to form a next latent image. The scraped-off toner is collected in the used-toner container 76*a*.

Outline of the Control

Next, with reference to FIG. 4, explanation will be made of the configuration of the control unit 100. FIG. 4 is a block diagram showing a control unit 100 provided in the printer 10.

The main controller 101 of the control unit 100 is connected to the host computer through the interface (I/F) 112 and has an image memory 113 for storing image signals input from the host computer.

The unit controller 102 of the control unit 100 is electrically connected to each of the units (i.e., the charging unit 30, the exposing unit 40, the first transferring unit 60, the photoconductor unit 75, the second transferring unit 80, the fusing unit 90, and the displaying unit 95) and the YMCK developing device 50. By receiving signals from sensors provided on each of the units/devices, the unit controller 102 detects the state of each unit and the YMCK developing device 50; further, the unit controller 102 also controls each unit and the YMCK developing device 50 according to the signals input from the main controller 101. In FIG. 4, a photoconductor unit drive control circuit, a charging unit drive control circuit, an exposing unit drive control circuit 127, a YMCK developing device drive control circuit 125, a first transferring unit drive control circuit, a second transferring unit drive control circuit, a fusing unit drive control circuit, and a displaying unit drive control circuit are shown as structural components for driving each of the units and the YMCK developing device 50.

The exposing unit drive control circuit 127 connected to the exposing unit 40 has a pixel counter 127*a* for detecting the consumption amount of the developer. According to a signal that represents the number of pixels input to the exposing unit drive control circuit 127, the pixel counter 127*a* counts the number of pixels input to the exposing unit 40. Note that the pixel counter 127*a* can be provided in/on the exposing unit 40 or in the main controller 101. Note that the "number of pixels" is the number of pixels per basic resolution of the printer 10, that is, the number of pixels of an actually-printed image. Since the consumption amount (usage amount) of toner T is in proportion to the number of pixels, it is possible to detect the consumption amount of toner T by counting the number of pixels.

Alternating voltage is supplied to the YMCK developing device drive control circuit 125 from an alternating voltage supplying section 126*a*, and direct-current voltage is supplied to the YMCK developing device drive control circuit 125 from a direct-current voltage supplying section 126*b*. At an appropriate timing, the drive control circuit 125 applies, to the developing roller of the developing unit selectively opposing the photoconductor 20, a voltage obtained by superposing the alternate voltage on the direct-current voltage in order to establish an alternating electric field between the developing roller and the photoconductor 20. Further, the YMCK developing device drive control circuit 125 supplies, to the developing roller drive motor described above, a drive control signal for driving and rotating the developing roller of the developing unit opposing the photoconductor 20.

The CPU 120 in the unit controller 102 is connected to a nonvolatile storage element, such as a serial EEPROM, via the serial interface (I/F) 121.

The unit controller 102 has a ROM 130 and a RAM 131. The ROM 130 stores, in advance, data such as table data and program data for controlling the operations of the unit controller 102. Hardware that configures the ROM 130 includes nonvolatile storage elements such as a masked ROM in which data is permanently stored during the manufacturing process, an EPROM in which data is erasable with ultraviolet rays, and an EEPROM (including flash ROM) in which data is electrically erasable. The RAM 131 stores working data such as calculation results of the CPU 120. Hardware that configures the RAM 131 can either be volatile storage elements such as SRAMs or nonvolatile storage elements such as EEPROMs. However, it data-holding function is to be given higher priority, then it is preferable to use the latter, i.e., nonvolatile storage elements.

Information about the actual temperature obtained by the temperature sensor 97 (i.e., the inside temperature of the printer 10) is stored in the RAM 131. The CPU 120 monitors the change over time of the temperature information stored in the RAM 131 employing time signals clocked by a timer 132.

Table Data in ROM 130

The ROM 130 stores, in advance, table data such as the one shown in FIG. 5 in which the temperature inside the printer 10 is associated with a reference value of a total number of sheets printed, a reference value of a total number of times a developer roller of a developing unit has rotated, and a reference value of a total number of times synchronizing signals Vsync have been generated. It is to be noted that the degree of physical agglomeration of the developer depends on the temperature inside the printer 10. In consideration of such a fact, the temperature inside the printer 10 is divided into three ranges, "10 through 23° C.", "24 through 30° C.", and "31 through 35° C.", and different reference values of a total number of sheets printed, a total number of times a developer roller of a developing unit has rotated, and a total number of times synchronizing signals Vsync have been generated are associated with each of the three temperature ranges. Note that the table stored in the ROM 130 is not limited to the table data described above. The table data stored in the ROM 130 can appropriately be changed if the data stored in the ROM 130 is data that is referred to in order to reduce the decrease in flowability of the developer.

Outline of Developing

Figure 6:
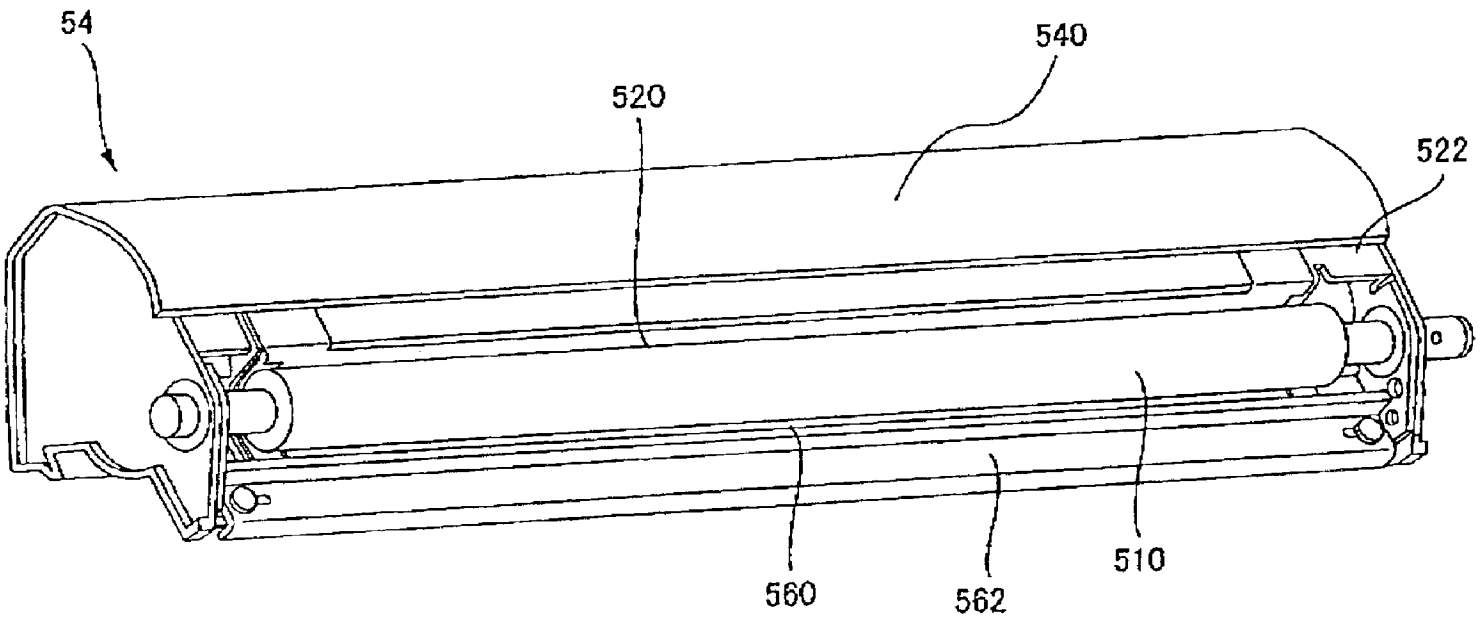
FIG. 6 is a perspective view of a yellow developing unit 54 taken from the side of a developing roller 510.
Figure 7:
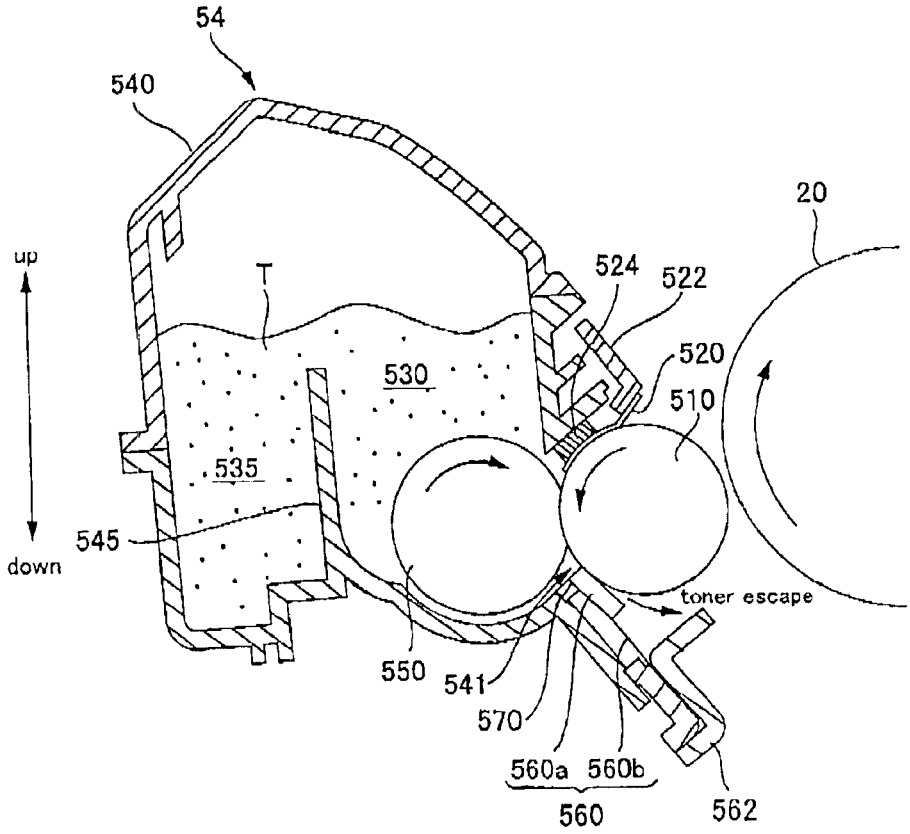
FIG. 7 is a section view showing some main structural components of the yellow developing unit 54.

Next, with reference to FIG. 6 and FIG. 7, the outline of a developing unit will be described. FIG. 6 is a perspective view of the yellow developing unit 54 taken from the side of the developing roller 510. FIG. 7 is a section view showing some main structural components of the yellow developing unit 54. Note that, also in FIG. 7, the arrow indicates the vertical directions; for example, the central axis of the developing roller 510 is located below the central axis of the photoconductor 20. Further, FIG. 7 shows a state in which the yellow developing unit 54 is located in the developing position opposing the photoconductor 20.

The YMCK developing device 50 is provided with: the cyan developing unit 51 containing cyan (C) toner; the magenta developing unit 52 containing magenta (M) toner; the black developing unit 53 containing black (K) toner; and the yellow developing unit 54 containing yellow (Y) toner. Since the configuration of each of the developing units is the same, explanation will be made only of the yellow developing unit 54.

The yellow developing unit 54 includes, for example: a developer container, i.e., a first container 530 and a second container 535, for containing the yellow toner T serving as the developer; an element (not shown) for storing information; a housing 540; the developing roller 510, which serves as a "developer bearing member"; a toner-supplying roller 550 for supplying toner T to the developing roller 510; and a restriction blade 560 for restricting the thickness of the toner T bore by the developing roller 510.

The housing 540 is manufactured by joining together, for example, an integrally molded upper housing and a lower housing. The inside of the housing 540 is divided into the first container 530 and the second container 535 by a restriction wall 545 extending from the bottom to an upper section of the housing 540 (in the vertical direction in FIG. 7). The first container 530 and the second container 535 form a developer container (530, 535) for containing the toner T, which serves as the developer. The upper sections of the first and second containers 530, 535 communicate with each other. The movement of the toner T is restricted by the restriction wall 545. Note that a stirring member for stirring the toner T contained in the first container 530 and the second container 535 may be provided. However, in the present embodiment, each of the developing units (the cyan developing unit 51, the magenta developing unit 52, the black developing unit 53, and the yellow developing unit 54) rotate with the rotation of the rotary 55, and the toner T contained in each developing unit is stirred according to this rotation; therefore, the first and second containers 530, 535 are not provided with a stirring member.

On the outer surface of the housing 540 in its longitudinal direction is provided an element (not shown) into which information can be written. The element has a configuration in which the written information can be stored.

At the lower section of the first container 530 is provided an opening 541 that communicates with the outside of the housing 540. In the first container 530 is provided a toner-supplying roller 550. The toner-supplying roller 550 is rotatably supported on the housing 540 and is arranged so that its circumferential surface fronts on the opening 541. From the outside of the housing 540 is provided a developing roller 510 in a manner that its circumferential surface fronts on the opening 541. The developing roller 510 is placed in contact with (i.e., abuts against) the toner-supplying roller 550.

The developing roller 510 bears the toner T and delivers it to a developing position at which the roller 510 opposes the photoconductor 20. The developing roller 510 is made from, for example, aluminum, stainless steel, or iron. If necessary, the roller 510 is plated with, for example, nickel plating or chromium plating, and/or subjected to appropriate treatment such as sand blasting at toner-bearing areas. Further, the developing roller 510 is rotatable about a central axis. As shown in FIG. 7, the roller 510 rotates in the opposite direction (counterclockwise in FIG. 7) to the rotating direction of the photoconductor 20 (clockwise in FIG. 7). The central axis of the roller 510 is located below the central axis of the photoconductor 20. The central axis of the developing roller 510 is connected, either directly or indirectly, to a developing roller drive motor in a state in which the developing roller 510 opposes the photoconductor 20. In this way, the driving force of the developing roller drive motor is transferred to the developing roller 510, and the developing roller 510 is made to rotate in the direction opposite to the rotating direction of the photoconductor 20. Note that, if the central axis of the developing roller 510 is connected indirectly to the developing roller drive motor, a reduction mechanism (not shown) such as a gearing can be provided between the central axis of the developing roller 510 and the side of the developing roller drive motor from which driving force is output. As shown in FIG. 7, in a state in which the yellow developing unit 54 opposes the photoconductor 20, there exists a gap between the developing roller 510 and the photoconductor 20. That is, the yellow developing unit 54 develops the latent image formed on the photoconductor 20 in a non-contacting state. Note that an alternating electric field is established between the developing roller 510 and the photoconductor 20 upon developing the latent image formed on the photoconductor 20.

The toner-supplying roller 550 supplies the toner T contained in the first container 530 and the second container 535 to the developing roller 510. The toner-supplying roller 550 is made from, for example, polyurethane foam and the like, and is placed in contact with the developing roller 510 in an elastically-deformed state. The toner-supplying roller 550 is arranged at a lower section of the first container 530. The toner T contained in the first and second containers 530, 535 is supplied to the developing roller 510 by the toner-supplying roller 550 at the lower section of the first container 530. The toner-supplying roller 550 is rotatable about a central axis. The central axis is situated below the central axis of rotation of the developing roller 510. Further, the toner-supplying roller 550 rotates in the opposite direction (clockwise in FIG. 7) to the rotating direction of the developing roller 510 (counterclockwise in FIG. 7). Note that the toner-supplying roller 550 has functions to supply the toner T contained in the first container 530 and the second container 535 to the developing roller 510 and to strip the toner T remaining on the developing roller 510 after development off from the developing roller 510.

The restriction blade 560 restricts the thickness of the layer of the toner T bore by the developing roller 510 and also gives charge to the toner T bore by the developing roller 510. The restriction blade 560 has a rubber portion **560*a* and a rubber-supporting portion 560*b*. The rubber portion 560*a* is made from, for example, silicone rubber or urethane rubber. The rubber-supporting portion 560*b* is a thin plate having a spring-like characteristic made from, for example, phosphor bronze or stainless steel. The rubber portion 560*a* is supported by the rubber-supporting portion 560*b*, whereas the rubber-supporting portion 560*b* is fixed, on one end thereof, to a blade-supporting metal plate 562. The blade-supporting metal plate 562 is fixed to a sealing frame (not shown) and, along with the restriction blade 560, forms a part of a sealing unit (not shown) and is mounted on the housing 540. In this state, the rubber portion 560***a* is pressed against the developing roller 510 by the elastic force caused by bending of the rubber-supporting portion 560*b*.

A blade-backing member 570 made from, for example, Moltoprene is provided on the other side of the restriction blade 560 opposite from the side of the developing roller 510. The blade-backing member 570 prevents the toner T from entering between the rubber-supporting portion 560*b* and the housing 540 and stabilizes the elastic force caused by bending of the rubber-supporting portion 560*b*. Further, the blade-backing member 570 impels the rubber portion 560*a* from the back thereof towards the developing roller 510 to press the rubber portion 560*a* against the developing roller 510. In this way, the blade-backing member 570 makes the rubber portion 560*a* abut against the developing roller 510 more evenly and also enhances the sealing characteristic of the rubber portion 560*a*.

The other end of the restricting blade 560 that is not being supported by the blade-supporting metal plates 562 (i.e., the tip end of the restriction blade 560) is not placed in contact with the developing roller 510; rather, a section at a predetermined distance from the tip end contacts, with some breadth, the developing roller 510. In other words, the restriction blade 560 does not abut against the developing roller 510 at its tip end, but abuts against the roller 510 near its central portion. Further, the restriction blade 560 is arranged so that its tip end faces towards the upper stream of the rotating direction of the developing roller 510, and thus, makes a so-called counter-contact with respect to the roller 510. Note that the butting position at which the restriction blade 560 abuts against he developing roller 510 is situated below the central axis of the developing roller 510 and also below the central axis of the toner-supplying roller 550.

The sealing member 520 prevents the toner T in the yellow developing unit 54 from escaping out therefrom, and also collects the toner T, which is on the developing roller 510 that has passed the developing position, into the developing unit without scraping. The sealing member 520 is a seal made of, for example, polyethylene film. The sealing member 520 is supported by a seal-supporting metal plate 522, and is mounted on the frame 540 via the seal-supporting metal plate 522. A seal-impelling member 524 made from, for example, Moltoprene is provided on one side of the sealing member 520 opposite from the side of the developing roller 510. The sealing member 520 is pressed against the developing roller 510 by the elastic force of the seal-impelling member 524. Note that the abutting position at which the sealing member 520 abuts against the developing roller 510 is situated above the central axis of the developing roller 510.

In the yellow developing unit 54 thus structured, the toner-supplying roller 550 supplies, to the developing roller 510, the toner T contained in the first container 530 and the second container 535, which serve as a developer container. With the rotation of the developing roller 510, the toner T supplied to the developing roller 510 reaches the abutting position of the restriction blade 560; and, as the toner T passes the abutting position, the toner is charged and its thickness is restricted. With further rotation of the developing roller 510, the toner T on the developing roller 510, whose thickness has been restricted, reaches the developing position opposing the photoconductor 20; and under the alternating electric field, the toner T is used, at the developing position, for developing the latent image formed on the photoconductor 20. With further rotation of the developing roller 510, the toner T on the developing roller 510, which has passed the developing position, passes by the sealing member 520 and is collected into the developing unit by the sealing member 520 without being scraped off.

Information Stored in the RAM 131

Next, with reference to FIG. 8, information stored in RAM 131 will be described below. FIG. 8 is a diagram for illustrating the information stored in the RAM 131.

When an image signal is supplied from the host computer to the main controller 101 and instructions based on the image signal are supplied from the main controller 101 to the unit controller 102, the unit controller 102 supplies, to each of the units in the printer 10 and to the YMCK developing device 50, various drive control signals for executing the above-described operations of the printer 10 according to results obtained by reading the program data that has been read out from the ROM 130. Accordingly, the above-described series of operations performed from when the photoconductor 20 is charged by the charging unit 30 until when the object subjected to transferring is heated and pressurized by the fusing unit 90 is executed in the printer 10.

When the printer 10 is in a state where it is capable of executing the above-described series of operations, the RAM 131 stores the following four pieces of information according to results obtained by reading the program data that has been read out from the ROM 130:

(i) information about the temperature inside the apparatus obtained by the temperature sensor 97;

(ii) information about the total number of sheets printed obtained based on a command about the number of sheets to be printed, the command being included in the image signal sent from the host computer;

(iii) information about the total number of times the developer roller 510 has rotated obtained based on the number of times the developing roller drive motor has rotated; and (iv) information about the total number of times synchronizing signals Vsync have been generated.

The "temperature inside the apparatus" is the temperature that is read by the temperature sensor 97 and updated every time the timer 132 clocks a predetermined amount of time TA (for example, 10 minutes). The "number of sheets printed", the "number of times the developing roller 510 has rotated", and the "number of times the synchronizing signals Vsync have been generated" are pieces of information that are reset when the printer is turned ON or when the rotary 50 rotationally moves to stir the toner T in each developing unit 51, 52, 53, 54, and that are summed afresh after having been reset. In the present embodiment, it is assumed that the "total number of times the developer roller 510 has rotated" is the total number of times of rotations for each of the four developing rollers 510 of the respective four developing units 51, 52, 53, 54 and that the RAM 131 stores such total numbers of times of rotations. However, the "total number of times the developer roller 510 has rotated" can be a total number of times for which all four developing rollers 510 have rotated. Further, when a developing unit in use is exchanged for a new developing unit, the CPU 120 detects a change in ID information stored in the element of the developing unit, and thereby the total number of times the developer roller 510 has rotated, which is stored in the RAM 131, is reset.

For example, in the RAM 131: the temperature inside the apparatus is stored in address 00H (H indicates a digit in hexadecimal); the total number of sheets printed is stored in address 01H; the total number of times the developer roller 510 of the yellow developing unit 54 has rotated (i.e., the total number of times of rotations of the Y developer roller) is stored in address 02H; the total number of times the developer roller of the magenta developing unit 52 has rotated (i.e., the total number of times of rotations of the M developer roller) is stored in address 03H; the total number of times the developer roller of the cyan developing unit 51 has rotated (i.e., the total number of times of rotations of the C developer roller) is stored in address 04H; the total number of times the developer roller of the black developing unit 53 has rotated (i.e., the total number of times of rotations of the K developer roller) is stored in address 05H; and the total number of times synchronizing signals Vsync have been generated is stored in address 06H.

Developer-Stirring Operation of the Control

Figure 9:
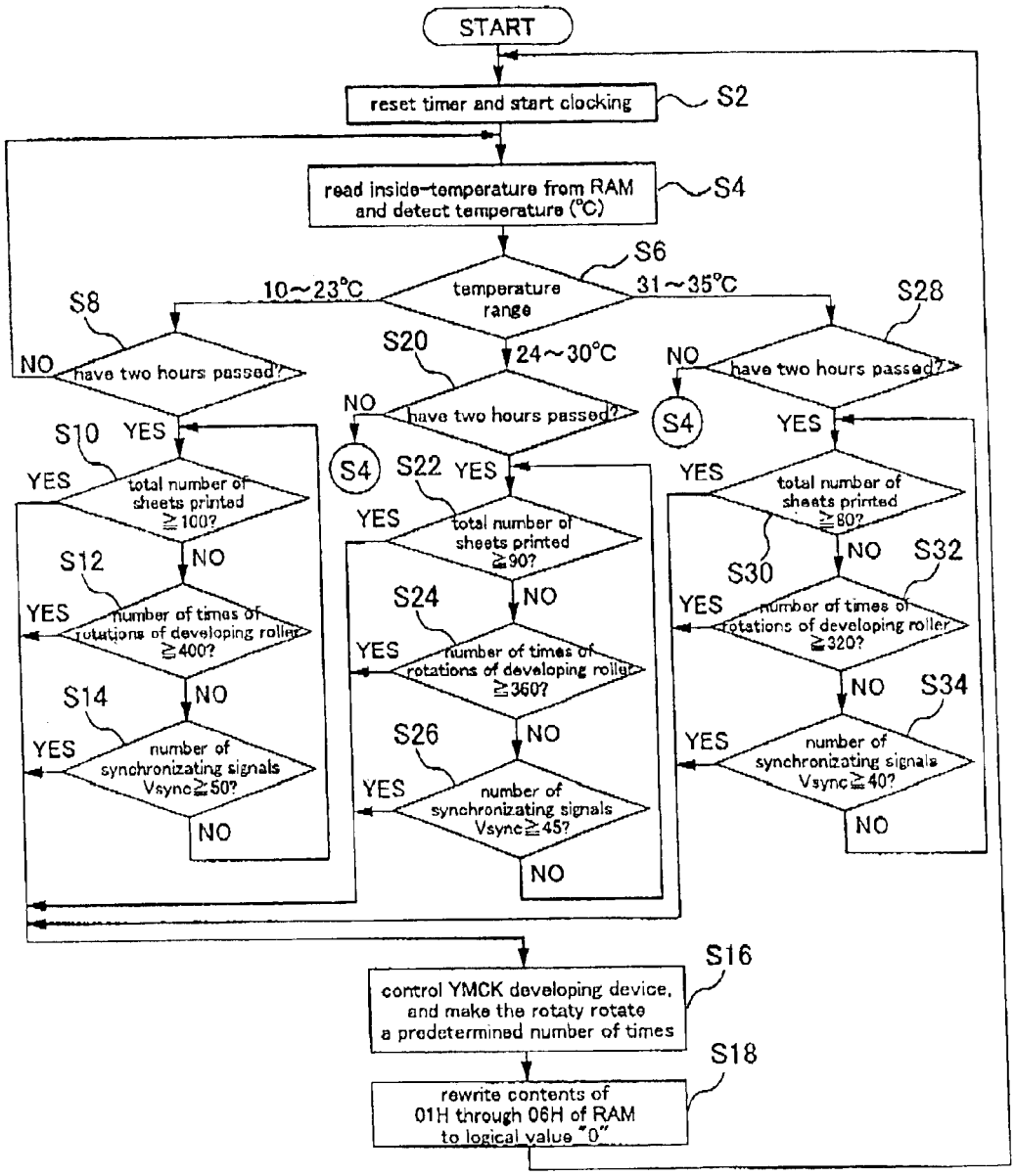
FIG. 9 is a flowchart illustrating an example of control operations of the control unit 100 for stirring developer.
Figure 10:
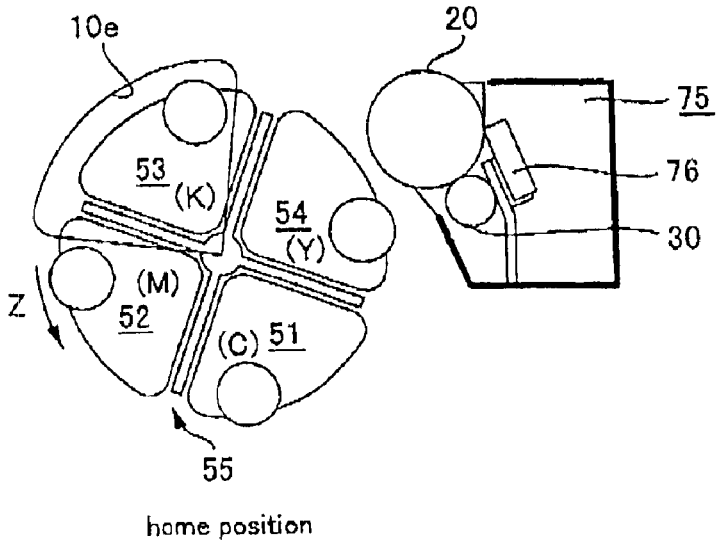
FIG. 10 is a diagram showing a state in which a rotary 55 is in its home position.

Next, with reference to FIG. 9 and FIG. 10, the control operation of the control unit 100 for stirring the developer will be described below. FIG. 9 is a flowchart illustrating an example of control operations of the control unit 100 for stirring the developer. FIG. 10 is a diagram showing a state in which the rotary 55 is in its home position.

First, when the printer 10 is turned ON, the unit controller 102 supplies, to the printer 10, a drive control signal for setting the printer 10 in an initial state. In the printer 10, each of the units and the YMCK developing device 50 are set to their initial states according to this drive control signal. Specifically, as shown in FIG. 10, the rotary 55 stops at a home position in which the yellow developing unit 54 opposes the photoconductor 20. In the unit controller 102, the timer 132 is reset and starts to clock, and the contents stored for each of the addresses of the RAM 131 are initialized (set to a logical value "0".) That is, in response to resetting of the timer 132, various kinds of information such as those shown in FIG. 8 will start to be stored in the addresses 00H through 06H of the RAM 131 (S2).

When the YMCK developing device 50 is not developing a latent image formed on the photoconductor 20, the CPU 120 reads out the temperature inside the apparatus that is stored in address 00H of the RAM 131 and detects the temperature inside the apparatus (for example, in ° C.) (S4).

After detecting the actual temperature inside the apparatus at step S4, the CPU 120 determines which of the temperature ranges "10 through 23° C.", "24 through 30° C.", and "31 through 35° C. " stored in the table data of the ROM 130 the actual temperature inside the apparatus belongs to (S6).

<Operations Performed When the Actual Temperature Inside the Apparatus is Within "10 Through 23° C."><br>

For example, when the CPU 120 determines that the actual temperature inside the apparatus belongs to the temperature range of "10 through 23° C.", then the CPU 120 determines whether the timer 132 has clocked a predetermined period of time TB (for example, two hours) after being reset at step S2. Note that the predetermined period of time TB can be set to a period of time that matches the environment in which the printer 10 is placed. For example, it the environment in which the printer 10 is placed is hot and humid, the predetermined period of time TB can be set to a shorter period, since the toner T tends to cause physical agglomeration easily (S8). If the CPU 120 determines that the timer 132 has not clocked two hours (S8: NO), then CPU 120 again executes the steps of S4 and onward. That is, the CPU 120 repeats the operations of again determining which of the temperature ranges "10 through 23° C.", "24 through 30° C.", and "31 through 35° C." the latest temperature inside the apparatus belongs to.

When the CPU 120 determines that the timer 132 has clocked two hours in a state where the actual temperature inside the apparatus is in the range of "10 through 23° C." (S8: YES), in other words, if it is determined that the toner T is in a state where it will easily cause physical agglomeration, the CPU 120 reads out the total number of sheets printed stored in address 01H of the RAM 131 and determines whether the read-out total number of sheets printed is equal to or above the reference value "100" of the total number of sheets printed corresponding to the temperature range "10 through 23° C." stated in the table data in the ROM 130 (S10).

If, at step S10, the CPU 120 determines that the total number of sheets printed stored in address 01H of the RAM 131 is below the reference value "100" (S10: NO), then, the CPU 120 reads out the total number of times the developer roller 510 of the yellow developing unit 54 has rotated, which is stored in address 02H of the RAM 131, and determines whether the read-out total number of times of rotations is equal to or above the reference value "400" of the total number of times of rotations corresponding to the temperature range "10 through 23° C." stated in the table data of the ROM 130. In the same way, the CPU 120 reads out the total number of times the developer roller of the magenta developing unit 52 has rotated, which is stored in address 03H of the RAM 131, the total number of times the developer roller of the cyan developing unit 51 has rotated, which is stored in address 04H of the RAM 131, and the total number of times the developer roller of the black developing unit 53 has rotated, which is stored in address 05H of the RAM 131, and determines whether those read-out total numbers of times of rotations are equal to or above the reference value "400" (S12).

If, at step S12, the CPU 120 determines that all of the total numbers of times of rotations stored in the addresses 02H through 05H of the RAM 131 are below the reference value "400" (S12: NO), then, the CPU 120 reads out the total number of times synchronizing signals Vsync have been generated, which is stored in address 06H of the RAM 131, and determines whether the read-out total number of times of generation is equal to or above the reference value "50" of the total number of times of generation corresponding to the temperature range "10 through 23° C." stated in the table data of the ROM 130 (S14).

If, at step S14, the CPU 120 determines that the total number of times of generation stored in address 06H of the RAM 131 is below the reference value "50" (S14: NO), then the CPU 120 again executes the above-described steps of S10 and onward.

The total number of sheets printed, the total number of times the developer roller has rotated, and the total number of times the synchronizing signals Vsync have been generated, which are stored in the RAM 131, are preferable factors for determining the state of use of each developing unit 51, 52, 53, 54 when the actual temperature inside the apparatus is within the temperature range of "10 through 23° C.". In consideration of the above, if any one of the determinations in steps S10, S12, or S14 is positively affirmed (S10: YES, S12: YES, or S14; YES), the YMCK developing device drive control circuit 125 supplies, to the YMCK developing device 50, a drive control signal for making the rotary 55 drive to rotate. Accordingly, the rotary 55 rotates about the central axis 50*a* from its home position (shown in FIG. 10) in the counter-clockwise direction Z for a predetermined number of times (for example, ten times).

That is, the toner T in each developing unit 51, 52, 53, 54 is stirred and is prevented from physically agglomerating. Note that the number of times the rotary 55 is rotated can appropriately be changed (S16).

After the YMCK developing device drive control circuit 125 outputs the drive control signal for driving and rotating the rotary 55, the contents stored in the addresses 01H through 06H of the RAM 131 are rewritten to the logical value "0", and the CPU 120 again executes the above-described steps of S2 and onward (S18).

<Operations Performed When the Actual Temperature inside the Apparatus is Within "24 Through 30° C.">

For example, when the CPU 120 determines that the actual temperature inside the apparatus belongs to the temperature range of "24 through 30° C.", then the CPU 120 determines whether the timer 132 has clocked a predetermined period of time TB (for example, two hours) after being reset at step S2. Note that, since the actual temperature inside the apparatus is in the range "24 through 30° C.", which is higher than the temperature range "10 through 23° C.", and the environment is such that the toner will cause physical agglomeration more easily, the predetermined period of time TB can be set to be below two hours (S20). If the CPU 120 determines that the timer 132 has not clocked two hours (S20: NO), then the CPU 120 again executes the steps of S4 and onward. That is, the CPU 120 repeats the operations of again determining which of the temperature ranges "10 through 23° C.", "24 through 30° C.", and "31 through 35° C." the latest temperature inside the apparatus belongs to.

When the CPU 120 determines that the timer 132 has clocked two hours in a state where the actual temperature inside the apparatus is included in the range of "24 through 30° C." (S20; YES), in other words, if it is determined that the toner T is in a state where it will easily cause physical agglomeration, the CPU 120 reads out the total number of sheets printed stored in address 01H of the RAM 131 and determines whether the read-out total number of sheets printed is equal to or above the reference value "90" of the total number of sheets printed corresponding to the temperature range "24 through 30° C." stated in the table data in the ROM 130 (S22).

If, at step S22, the CPU 120 determines that the total number of sheets printed stored in address 01H of the RAM 131 is below the reference value "90" (S22: NO), then, the CPU 120 reads out the total number of times the developer roller 510 of the yellow developing unit 54 has rotated, which is stored in address 02H of the RAM 131, and determines whether the read-out total number of times of rotations is equal to or above the reference value "360" of the total number of times of rotations corresponding to the temperature range "24 through 30° C." stated in the table data of the ROM 130. In the same way, the CPU 120 reads out the total number of times the developer roller of the magenta developing unit 52 has rotated, which is stored in address 03H of the RAM 131, the total number of times the developer roller of the cyan developing unit 51 has rotated, which is stored in address 04H of the RAM 131, and the total number of times the developer roller of the black developing unit 53 has rotated, which is stored in address 05H of the RAM 131, and determines whether those read-out total numbers of times of rotations are equal to or above the reference value "360" (S24).

If, at step S24, the CPU 120 determines that all of the total numbers of times of rotations stored in the addresses 02H through 05H of the RAM 131 are below the reference value "360" (S24: NO), then, the CPU 120 reads out the total number of times synchronizing signals Vsync have been generated, which is stored in address 06H of the RAM 131, and determines whether the read-out total number of times of generation is equal to or above the reference value "45" of the total number of times of generation corresponding to the temperature range "24 through 30° C." stated in the table data of the ROM 130 (S26).

If, at step S26, the CPU 120 determines that the total number of times of generation stored in address 06H of the RAM 131 is below the reference value "45" (S26; NO), then the CPU 120 again executes the above-described steps of S22 and onward.

The total number of sheets printed, the total number of times the developer roller has rotated, and the total number of times the synchronizing signals Vsync have been generated, which are stored in the RAM 131, are preferable factors for determining the state of use of each developing unit 51, 52, 53, 54 when the actual temperature inside the apparatus is within the temperature range of "24 through 30° C.". In consideration of the above, if any one of the determinations in steps S22, S24, or S26 is positively affirmed (S22: YES, S24: YES, or S26: YES), the above-described steps of S16 and S18 are again executed. More specifically, the rotary 55 rotates from its home position in the counter-clockwise direction Z for a predetermined number of times, and thereby, the toner T in each developing unit 51, 52, 53, 54 is stirred. Further, the contents stored in the addresses 01H through 06H of the RAM 131 are rewritten to the logical value "0".

<Operations Performed When the Actual Temperature Inside the Apparatus is Within "31 Through 35° C.">

For example, when the CPU 120 determines that the actual temperature inside the apparatus belongs to the temperature range of "31 through 35° C.", then the CPU 120 determines whether the timer 132 has clocked a predetermined period of time TB (for example, two hours) after being reset at step S2. Note that, since the actual temperature inside the apparatus is in the range "31 through 35° C.", which is higher than the temperature range "24 through 30° C.", and the environment is such that the toner will cause physical agglomeration most easily, the predetermined period of time TB can be set to be below two hours (S28). If the CPU 120 determines that the timer 132 has not clocked two hours (S28: NO), then the CPU 120 again executes the steps of S4 and onward. That is, the CPU 120 repeats the operations of again determining which of the temperature ranges "10 through 23° C.", "31 through 35° C.", and "31 through 35° C." the latest temperature inside the apparatus belongs to.

When the CPU 120 determines that the timer 132 has clocked two hours in a state where the actual temperature inside the apparatus is included in the range of "31 through 35° C." (S28: YES), in other words, if it is determined that the toner T is in a state where it will easily cause physical agglomeration, the CPU 120 reads out the total number of sheets printed stored in address 01H of the RAM 131 and determines whether the read-out total number of sheets printed is equal to or above the reference value "80" of the total number of sheets printed corresponding to the temperature range "31 through 35° C." stated in the table data in the ROM 130 (S30).

If, at step S30, the CPU 120 determines that the total number of sheets printed stored in address 01H of the RAM 131 is below the reference value "80" (S30: NO), then, the CPU 120 reads out the total number of times the developer roller 510 of the yellow developing unit 54 has rotated, which is stored in address 02H of the RAM 131, and determines whether the read-out total number of times of rotations is equal to or above the reference value "320" of the total number of times of rotations corresponding to the temperature range "31 through 35° C." stated in the table data of the ROM 130. In the same way, the CPU 120 reads out the total number of times the developer roller of the magenta developing unit 52 has rotated, which is stored in address 03H of the RAM 131, the total number of times the developer roller of the cyan developing unit 51 has rotated, which is stored in address 04H of the RAM 131, and the total number of times the developer roller of the black developing unit 53 has rotated, which is stored in address 05H of the RAM 131, and determines whether those read-out total numbers of times of rotations are equal to or above the reference value "320" (S32).

If, at step S32, the CPU 120 determines that all of the total numbers of times of rotations stored in the addresses 02H through 05H of the RAM 131 are below the reference value "320" (S32; NO), then, the CPU 120 reads out the total number of times synchronizing signals Vsync have been generated, which is stored in address 06H of the RAM 131, and determines whether the read-out total number of times of generation is equal to or above the reference value "40" of the total number of times of generation corresponding to the temperature range "31 through 35° C." stated in the table data of the ROM 130 (S34).

If, at step S34, the CPU 120 determines that the total number of times of generation stored in address 06H of the RAM 131 is below the reference value "40" (S34; NO), then the CPU 120 again executes the above-described steps of S30 and onward.

The total number of sheets printed, the total number of times the developer roller has rotated, and the total number of times the synchronizing signals Vsync have been generated, which are stored in the RAM 131, are preferable factors for determining the state of use of each developing unit 51, 52, 53, 54 when the actual temperature inside the apparatus is within the temperature range of "31 through 35° C.". In consideration of the above, if any one of the determinations in steps S30, S32, or S34 is positively affirmed (S30: YES, S32: YES, or S34: YES), the above-described steps of S16 and S18 are again executed. More specifically, the rotary 55 rotates from its home position in the counter-clockwise direction Z for a predetermined number of times, and thereby, the toner T in each developing unit 51, 52, 53, 54 is stirred. Further, the contents stored in the addresses 01H through 06H of the RAM 131 are rewritten to the logical value "0".

Note that the processing order of steps S10 through S14, steps S22 through S26, and steps S30 through S34 can appropriately be changed. Further, the actual temperature inside the apparatus does not always have to be fixed in one of the ranges of "10 through 23° C.", "24 through 30° C.", and "31 through 35° C." every time step S6 is executed. In other words, the determination result at step S6 does not always have to end up in a fixed one of steps S8, S20, or S28 from the start to the end. Therefore, in the present embodiment, the values shown in either steps S8 onward, steps S20 onward, or steps S28 onward selected according to the latest determination result at step S6 are to be used as the reference values of the total number of sheets printed, the total number of times a developer roller has rotated, and the total number of times the synchronizing signals Vsync have been generated.

<Operations During Monochrome Continuous Printing>

When the image signal sent from the host computer includes a command to execute monochrome continuous printing, in the unit controller 102, the YMCK developing device drive control circuit 125 supplies to the YMCK developing device 50 a drive control signal to perform monochrome continuous printing. Accordingly, in the YMCK developing device 50, the rotary 55 rotates from its home position (shown in FIG. 10) in the counter-clockwise direction Z, and the black developing unit 53 stops in a state opposing the photoconductor 20. During monochrome continuous printing, the black developing unit 53 stays opposed to the photoconductor 20 and continuously develops the latent image formed on the photoconductor 20. More specifically, since the developing roller of the black developing unit 53 rotates continuously, heat such as frictional heat caused between the restriction blade 560 and the rubber portion 560*a* and driving heat from the developing roller drive motor will be transferred to the developing roller, and the roller will bear high temperature. For this reason, the toner T on the developing roller tends to cause physical agglomeration easily.

In view of the above, after finishing the monochrome continuous printing with the printer 10, the CPU 120 reads out the number of times the developer roller of the black developing unit 53 has rotated, which is stored in address 05H of the RAM 131, and compares the read-out value with the reference value (for example, 100) of the number of times of rotations stored in the ROM 130. Then, the CPU 120 can execute the operations as those in the above-described steps S16 and S18 if the number of times the developer roller of the black developing unit 53 has rotated, which is stored in address 05H of the RAM 131, is equal to or above the reference value "100". Accordingly, the rotary 55 rotates from its home position in the counter-clockwise direction Z for a predetermined number of times, and thereby the toner T in each developing unit 51, 52, 53, 54 is stirred. Further, the contents stored in the addresses 01H through 06H of the RAM 131 are rewritten to the logical value "0". Also, the timer 132 is reset.

If the environment in which the printer 10 operates is hot and humid, there is a possibility that the toner T in each developing unit 51, 52, 53, 54, which are attached to the attaching/detaching sections 55*a*, 55*b*, 55*d*, 55*e* of the printer 10, may easily cause physical agglomeration due to moisture absorption. If the toner T in the developing units 51, 52, 53, 54 is left in the physically-agglomerated state, the toner T will settle at the bottom of the developer container and the flowability of the toner T will decrease. This can affect image forming.

In order to prevent physical agglomeration of the toner T contained in the developing units 51, 52, 53, 54, in a printer 10 using developing units 51, 52, 53, 54 that do not have stirring members (such as agitators), it is effective to rotationally move the rotary 55, to which the developing units 51, 52, 53, 54 are attached, making use of a period in which none of the developing units 51, 52, 53, 54 is developing a latent image on formed on the photoconductor 20. However, if the rotary 55 is made to rotate at a fixed timing, a situation may occur in which it is not possible to stir the toner T even when it is actually necessary to stir the toner T in the developing units 51, 52, 53, 54.

In view of the above, the timing for rotationally moving the rotary 55 to stir the toner T in the developer container is made variable. Therefore, it becomes possible to appropriately stir the toner T and reduce the decrease in flowability of the toner T.

As a result, since the tendency for the toner T in the developer container to physically agglomerate is reduced, it becomes possible to solve the inconvenience that, when the developing roller 510 rotates in the counter-clockwise direction as shown in FIG. 7, the restriction blade 560 will be separated from the developing roller 510 and the toner T that has caused physical agglomeration will escape out from the developing unit (i.e., escape in the direction of the arrow in the figure).

Further, by making the timing for rotationally moving the rotary 55, which is capable of moving rotationally, to be variable, it becomes possible to reduce the decrease in flowability of the toner T.

Further, the rotary 55 may move rotationally to make the developing units 51, 52, 53, 54 selectively oppose the photoconductor 20 when the developing units 51, 52, 53, 54 attached to each of the attaching/detaching sections 55*a*, 55*b*, 55*d*, 55*e* are to develop a latent image formed on the photoconductor 20.

In this way, it is possible to reduce a decrease in flowability of the toner T by making the timing for rotationally moving the rotary 55, which moves rotationally to make the developing units 51, 52, 53, 54 selectively oppose the photoconductor 20, variable.

Further, the timing for rotationally moving the rotary 55 may be made variable according to information obtained when only the black developing unit 53 has continuously developed a latent image formed on the photoconductor 20.

In this way, it is possible to reduce a decrease in flowability of the toner T by making the timing for rotationally moving the rotary 55 variable according to information obtained when only the black developing unit 53 has continuously developed a latent image formed on the photoconductor 20.

Further, the timing for rotationally moving the rotary 55 may be made variable according to information about an environment in which the printer 10 operates.

In this way, it is possible to reduce a decrease in flowability of the toner T by making the timing for rotationally moving the rotary 55 variable according to information about an environment in which the printer 10 operates.

Further, the printer may further comprise a temperature sensor 97, and the information about the environment may be temperature information obtained by the temperature sensor 97.

In this way, it is possible to reduce a decrease in flowability of the toner T using the temperature information about the environment in which the printer 10 operates.

Further printer may further comprise a humidity sensor 98, and the information about the environment may be humidity information obtained by the humidity sensor 98.

In this way, it is possible to reduce a decrease in flowability of the toner T using the humidity information about the environment in which the printer 10 operates.

Further, the timing for rotationally moving the rotary 55 may be made variable according to the information about the environment, and information about a number of sheets printed that is associated with the information about the environment. More specifically, the rotary 55 may be rotationally moved to stir the toner T in the developer container when the information about the environment continues to stay at a predetermined value for a predetermined period of time, and the information about a number of sheets printed reaches a value that is associated with the predetermined value of the information about the environment.

In this way, it is possible to effectively reduce a decrease in flowability of the toner T by making the timing for rotationally moving the rotary 55 variable according to a result obtained by combining the information about the environment and the information about a number of sheets printed.

Further, each of the developing units 51, 52, 53, 54 may have a developing roller for bearing the toner T, and the timing for rotationally moving the rotary 55 may be made variable according to the information about the environment, and information about a number of times the developing roller has rotated that is associated with the information about the environment. More specifically, the rotary 55 may be rotationally moved to stir the toner T in the developer container when the information about the environment continues to stay at a predetermined value for a predetermined period of time, and the information about a number of times the developing roller has rotated reaches a value that is associated with the predetermined value of the information about the environment.

In this way, it is possible to effectively reduce a decrease in flowability of the toner T by making the timing for rotationally moving the rotary 55 variable according to a result obtained by combining the information about the environment and the information about a number of times the developing roller has rotated.

Further, the printer may further comprise a intermediate transferring member 70 serving as a medium in transferring an image on the photoconductor 20 to an object subjected to transferring, and the timing for rotationally moving the rotary 55 may be made variable according to the information about the environment, and information about a number of times the intermediate transferring member 70 has moved that is associated with the information about the environment. More specifically, the rotary 55 may be rotationally moved to stir the toner T in the developer container when the information about the environment continues to stay at a predetermined value for a predetermined period of time, and the information about a number of times the intermediate transferring member 70 has moved reaches a value that is associated with the predetermined value of the information about the environment.

In this way, it is possible to effectively reduce a decrease in flowability of the toner T by making the timing for rotationally moving the rotary 55 variable according to a result obtained by combining the information about the environment and the information about a number of times the intermediate transferring member 70 has moved.

Other Embodiments

Above, description was made of a developing unit and so on according to one embodiment of the present invention. However, the above-mentioned embodiment of the invention is merely for facilitating understanding of the present invention and is not to limit the scope of the present invention. It is without saying that the present invention may be altered and/or modified without departing from the scope thereof, and that the present invention includes its equivalents and the like.

<Timing for Rotationally Moving the Rotary>

It is possible to make the timing for rotationally moving the rotary 55 to stir the toner T in the developer container variable according to information other than the information about the environment of the printer 10 and the information obtained when monochrome continuous printing has been performed. For example, the timing for rotationally moving the rotary 55 can be made variable according to the amount of toner T used.

<Other Examples of Applying Alternating Voltage>

It is possible to configure the printer so that the alternating voltage supplying section 126*a* supplies alternating voltage to the charging unit 30 via the charging unit drive control circuit and the charging unit 30 charges the photoconductor 20 under an alternating electric field. Further, it is also possible to configure the printer so that the alternating voltage supplying section 126*a* supplies alternating voltage to the first transferring unit 60 via the first transferring unit drive control circuit.

<Developing Unit>

The developing unit is not limited to the device with the configuration described in the embodiment above, but any other kinds of developing units are applicable. The developing unit can have any kind of configuration as long as it has an element in which information can be written and a developer container. For example, the developing unit does not have to be provided with the developer bearing member, and instead, the developer bearing member may be provided on the printer body 10*a*.

For example, it is possible to use any kind of material that is capable of configuring the developer bearing member, such as magnetic material, nonmagnetic material, conductive material, insulating material, metal, rubber, and resin. For example, as kinds of material, it is possible to use: metal such as aluminum, nickel, stainless steel, and iron; rubber such as natural rubber, silicone rubber, polyurethane rubber, butadiene rubber, chloroprene rubber, neoprene rubber, and NBR; and resin such as polystyrene resin, vinyl chloride resin, polyurethane resin, polyethylene resin, methacrylate resin, and nylon resin. It is without saying that the upper layer of these materials can be coated. In this case, as the coating material, it is possible to use, for example: polyethylene, polystyrene, polyurethane, polyester, nylon, or acrylic resin. Further, the developer bearing member can be formed into any shape/structure such as an inelastic body, an elastic body, a single-layer structure, a multi-layer structure, a film, and a roller. Further, the developer is not limited only to toner, but other kinds of developer such as two component developer in which toner is mixed with a carrier can be used.

Further, the toner-supplying member is not limited to the device with the configuration described in the embodiment above, and, other than polyurethane foam described above, it is possible to use, for example, polystyrene foam, polyethylene foam, polyester foam, ethylene propylene foam, nylon foam, or silicone foam as the material thereof. Note that the foam cells of the toner-supplying means can either be open-cell foams or closed-cell foams. Note that, other than foam material, it is possible to use rubber material having elasticity. More specifically, it is possible to use a material in which rubber such as silicone rubber, polyurethane rubber, natural rubber, isoprene rubber, styrene butadiene rubber, butadiene rubber, chloroprene rubber, butyl rubber, ethylene propylene rubber, epichlorohydrin rubber, nitrile butadiene rubber, and acrylic rubber is dispersed with conductive agents, such as carbon, and molded.

<Photoconductor Unit>

The photoconductor unit 75 is not limited to the device with the configuration described in the embodiment above, but any other kind of device is applicable. The photoconductor unit 75 only needs to have an element in which information can be written and a photoconductor. For example, the photoconductor unit 75 does not have to be provided with the charging unit 30, and instead, the charging unit maybe provided on the printer body 10*a*. Further, the photoconductor is not limited to a photoconductive roller, but can be in a belt-like shape.

<Image-forming Apparatus>

In the above-explained embodiment, description was made of a full-color laser-beam printer of the intermediate-transferring type as an example of an image-forming apparatus. However, the present invention is applicable to various image-forming apparatuses such as full-color laser-beam printers other than the intermediate-transferring type, monochrome laser-beam printers, photocopiers, and facsimile machines.

Structure of Computer System Etc.

Next, with reference to the drawings, description will be made of a computer system, which is an example of an embodiment according the present invention.

Figure 11:
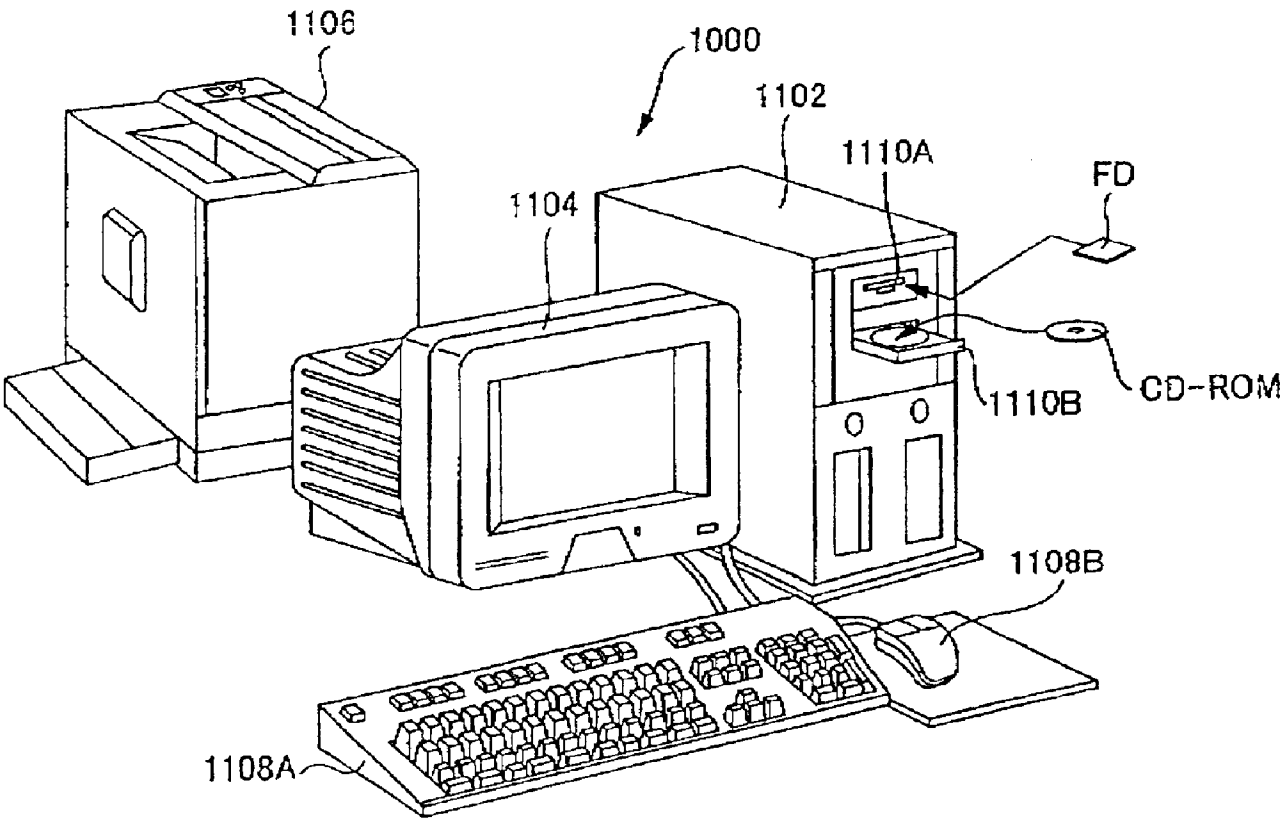
FIG. 11 is an explanatory diagram showing an external configuration of a computer system.

FIG. 11 is an explanatory diagram showing the external configuration of a computer system. The computer system 1000 includes: a computer unit 1102; a display device 1104; a printer 1106; an input device 1108; and a reading device 1110. In the present embodiment, the computer unit 1102 is housed in a casing such as a mini-tower; however the structure is not limited to this example. Although a CRT (cathode ray tube), a plasma display, or a liquid crystal display is generally used for the display device 1104, any other kind of device can be used. The printer explained above is used for the printer 1106. In the present embodiment, a keyboard 1108A and a mouse 1108B are used for the input device 1108; however, any other kind of device can be used. In the present embodiment, a flexible disk drive 1110A and a CD-ROM drive device 1110B are used for the reading device 1110; however, it is also possible to use an MO (magneto-optical) disk drive, a DVD (digital versatile disk) drive, or any other kind of device.

Figure 12:
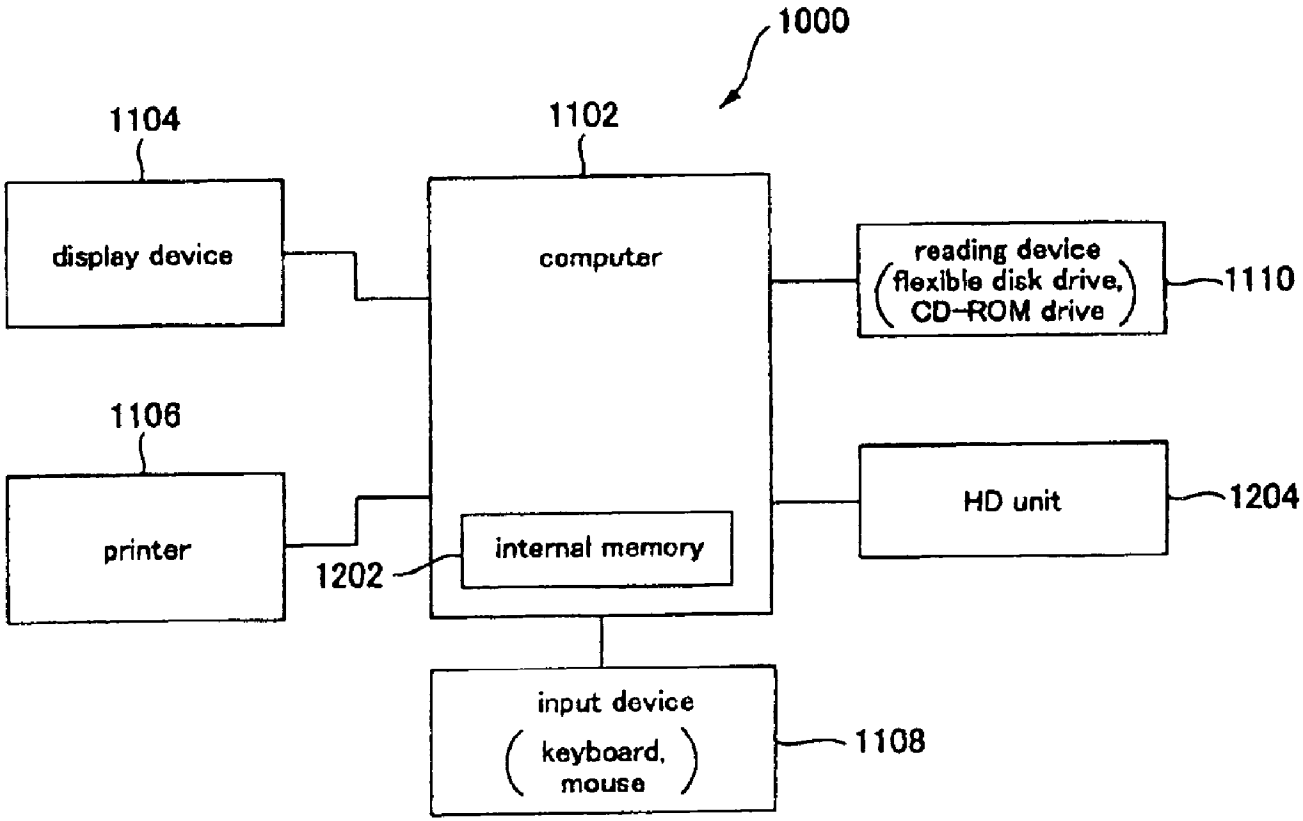
FIG. 12 is a block diagram showing a configuration of the computer system shown in FIG. 11.

FIG. 12 is a block diagram illustrating the configuration of the computer system shown in FIG. 11. FIG. 12 shows that an internal memory 1202, such as a RAM (random access memory), is provided inside the casing in which the computer unit 1102 is housed, and an external memory, such as a hard-disk drive unit 1204, are also provided.

In the above, description was made of an example in which the printer 1106 is connected to the computer unit 1102, the display device 1104, the input device 1108, and the reading device 1110 to configure the computer system. However, the configuration is not limited to the above. For example, the computer system may be configured comprising only the computer unit 1102 and the printer 1106, and it does not necessarily have to comprise the display device 1104, the input device 1108, and the reading device 1110.

Further, for example, it is also possible for the printer 1106 to have some of the functions or mechanisms of each of the computer unit 1102, the display device 1104, the input devices 1108, and the reading device 1110. For example, it is possible to structure the printer 1106 so that it comprises an image processor for image processing, a display section for performing various kinds of displaying, and a recording media mounting section for detachably mounting a recording medium on which image data captured with a digital camera or the like is stored.

A computer system configured as above will be superior to existing computer systems as a whole.

According to the present invention, it is possible to provide an image-forming apparatus and a computer system capable of reducing a decrease in flowability of developer.

What is claimed is:

1. An image-forming apparatus comprising:

a photoconductor on which a latent image can be formed; and a moving member having at least two attaching/detaching sections to/from each of which one of at least two developing units can be attached/detached, each of said developing units having a developer container for containing developer that is capable of developing the latent image formed on said photoconductor;

wherein said developer in said developer container is stirred by moving said moving member when none of said at least two developing units attached to each of said at least two attaching/detaching sections is developing a latent image formed on said photoconductor, and a timing for moving said moving member to stir the developer in said developer container is variable; and wherein said timing for moving said moving member is made variable according to information obtained when only a predetermined one said developing unit, among said at least two developing units attached to each of said at least two attached/detaching sections, has continuously developed a image formed on said photoconductor.

2. An image-forming apparatus comprising:

a photoconductor on which a latent image can be formed;

a moving member having at least two attaching/detaching sections to/from each of which one of at least two developing units can be attached/detached, each of said developing units having a developer container for containing developer that is capable of developing the latent image formed on said photoconductor, and a humidity sensor;

wherein said developer in said developer container is stirred by moving said moving member when none of said at least two developing units attached to each of said at least two attaching/detaching sections is developing a latent image formed on said photoconductor, and a timing for moving said moving member to stir the developer in said developer container is variable;

wherein said timing for moving said moving member is made variable according to information about an environment in which said image-forming apparatus operates; and wherein said information about said environment is humidity information obtained by said humidity sensor.

3. An image-forming apparatus comprising:

a photoconductor on which a latent image can be formed; and a moving member having at least two attaching/detaching sections to/from each of which one of at least two developing units can be attached/detached, each of said developing units having a developer container for containing developer that is capable of developing the latent image formed on said photoconductor;

wherein said developer in said developer container is stirred by moving said moving member when none of said at least two developing units attached to each of said at least two attaching/detaching sections is developing a latent image formed on said photoconductor, and a timing for moving said moving member to stir the developer in said developer container is variable;

wherein said timing for moving said moving member is made variable according to information about an environment in which said image-forming apparatus operates; and wherein said timing for moving said moving member is made variable according to said information about said environment, and information about a number of sheets printed that is associated with said information about said environment.

4. An image-forming apparatus according to claim 3, wherein said moving member is moved to stir the developer in said developer container when said information about said environment continues to stay at a predetermined value for a predetermined period of time, and said information about a number of sheets printed reaches a value that is associated with the predetermined value of said information about said environment.

5. An image-forming apparatus comprising:

a photoconductor on which a latent image can be formed; and a moving member having at least two attaching/detaching sections to/from each of which one of at least two developing units can be attached/detached, each of said developing units having a developer container for containing developer that is capable of developing the latent image formed on said photoconductor;

wherein said developer in said developer container is stirred by moving said moving member when none of said at least two developing units attached to each of said at least two attaching/detaching sections is developing a latent image formed on said photoconductor, and a timing for moving said moving member to stir the developer in said developer container is variable;

wherein said timing for moving said moving member is made variable according to information about an environment in which said image-forming apparatus operates;

wherein each of said developing units has a developer bearing member for bearing said developer; and wherein said timing for moving said moving member is made variable according to said information about said environment, and information about a number of times said developer bearing member has rotated that is associated with said information about said environment.

6. An image-forming apparatus according to claim 5, wherein said moving member is moved to stir the developer in said developer container when said information about said environment continues to stay at a predetermined value for a predetermined period of time, and said information about a number of times said developer bearing member has rotated reaches a value that is associated with the predetermined value of said information about said environment.

7. An image-forming apparatus comprising:

a photoconductor on which a latent image can be formed;

a moving member having at least two attaching/detaching sections to/from each of which one of at least two developing units can be attached/detached, each of said developing units having a developer container for containing developer that is capable of developing the latent image formed on said photoconductor; and a transferring medium serving as a medium in transferring an image on said photoconductor to an object subjected to transferring;

wherein said developer in said developer container is stirred by moving said moving member when none of said at least two developing units attached to each of said at least two attaching/detaching sections is developing a latent image formed on said photoconductor, and a timing for moving said moving member to stir the developer in said developer container is variable;

wherein said timing for moving said moving member is made variable according to information about an environment in which said image-forming apparatus operates; and wherein said timing for moving said moving member is made variable according to said information about said environment, and information about a number of times said transferring medium has moved that is associated with said information about said environment.

8. An image-forming apparatus according to claim 7, wherein said moving member is moved to stir the developer in said developer container when said information about said environment continues to stay at a predetermined value for a predetermined period of time, and said information about a number of times said transferring medium has moved reaches a value that is associated with the predetermined value of said information about said environment.

9. An image-forming apparatus comprising:

a photoconductor on which a latent image can be formed; and a moving member having at least two attaching/detaching sections to/from each of which one of at least two developing units can be attached/detached, each of said developing units having a developer container for containing developer that is capable of developing the latent image formed on said photoconductor, wherein said developer in said developer container is stirred by moving said moving member when none of said at least two developing units attached to each of said at least two attaching/detaching sections is developing a latent image formed on said photoconductor, a timing for moving said moving member to stir the developer in said developer container is variable, said moving member is capable of moving rotationally, said moving member moves rotationally to make said at least two developing units selectively oppose said photoconductor when said at least two developing units attached to each of said at least two attaching/detaching sections are to develop a latent image formed on said photoconductor, said timing for moving said moving member is made variable according to information about an environment in which said image-forming apparatus operates, said image-forming apparatus further comprises a temperature sensor, and said information about said environment is temperature information obtained by said temperature sensor, said timing for moving said moving member is made variable according to said information about said environment, and information about a number of sheets printed that is associated with said information about said environment, and said moving member is moved to stir the developer in said developer container when said information about said environment continues to stay at a predetermined value for a predetermined period of time, and said information about a number of sheets printed reaches a value that is associated with the predetermined value of said information about said environment.

10. A computer system comprising an image-forming apparatus that further comprises:

a photoconductor on which a latent image can be formed;

a moving member having at least two attaching/detaching sections to/from each of which one of at least two developing units can be attached/detached, each of said developing units having a developer container for containing developer that is capable of developing the latent image formed on said photoconductor;

wherein said developer in said developer container is stirred by moving said moving member when none of said at least two developing units attached to each of said at least two attaching/detaching sections is developing a latent image formed on said photoconductor; and a computer unit that is capable of being connected to said image-forming apparatus;

wherein a timing for moving said moving member to stir the developer in said developer container is variable; and wherein said timing for moving said moving member is made variable according to information obtained when only a predetermined one said developing unit, among said at least two developing units attached to each of said at least two attaching/detaching sections, has continuously developed a latent image formed on said photoconductor.

* * * * *